United States Patent [19]

Rich

[11] 4,260,394

[45] Apr. 7, 1981

[54] PROCESS FOR REDUCING THE SULFUR CONTENT OF COAL

[75] Inventor: Stanley R. Rich, Wellesley Hills, Mass.

[73] Assignee: Advanced Energy Dynamics, Inc., Natick, Mass.

[21] Appl. No.: 64,726

[22] Filed: Aug. 8, 1979

[51] Int. Cl.[3] ..... C10L 9/00

[52] U.S. Cl. ..... 44/1 SR; 201/17; 75/6

[58] Field of Search ..... 44/1 SR; 75/6; 201/17; 423/153, 154

[56] References Cited

U.S. PATENT DOCUMENTS

| | | | |
|---|---|---|---|
| 502,431 | 8/1893 | Eames | 75/6 X |
| 614,927 | 11/1898 | Burton | 75/6 X |
| 1,366,457 | 1/1921 | Hoopes | 201/17 X |
| 1,731,473 | 10/1929 | Naugle | 201/17 X |
| 4,052,170 | 10/1977 | Yan | 44/1 SR |
| 4,081,251 | 3/1978 | Colli | 44/1 SR |
| 4,152,120 | 5/1979 | Zavitsanos et al. | 44/1 SR |
| 4,155,715 | 5/1979 | Sass et al. | 44/1 SR |
| 4,169,710 | 10/1979 | Jensen | 44/1 SR |

FOREIGN PATENT DOCUMENTS

| | | | |
|---|---|---|---|
| 819588 | 9/1959 | United Kingdom | 201/17 |
| 851502 | 10/1960 | United Kingdom | 75/5 |
| 854729 | 11/1960 | United Kingdom | 75/5 |

*Primary Examiner*—Carl F. Dees

*Attorney, Agent, or Firm*—Wolf, Greenfield & Sacks

[57] ABSTRACT

After pulverizing to minus 200 mesh, a mixture of coal and pyrite particles is passed through an A.C. silent corona discharge in the presence of a reactant gas. Simultaneously, the particles are de-agglomerated and an electrical or magnetic difference between them is enhanced. Thereafter, the pyrite is separated from the coal. The effectiveness of the pulverizing step in separating pyrite particles from the coal matrix, especially small-size particles approximately 50 micrometers and less, is enhanced by pretreating the coal with a chemical comminutant. One example is a solution of ammonia, used to presoak the coal for a short time, at, for example, atmospheric pressure and ambient temperature.

8 Claims, 3 Drawing Figures

PROCESS FOR REDUCING THE SULFUR CONTENT OF COAL

BACKGROUND OF THE INVENTION

Owing primarily to environmental legal requirements, a copious coal resource of the United States of America is not being used to provide the share of the Nation's energy supply that it could provide. Much of the available coal contains sulfur, from 2-6% by weight, levels which have by law been declared intolerable. Many efforts have been made to find ways to remove the sulfur content, or at least to reduce it to an acceptable level but, so far, it has not been done. The problem is described in a paper by Sabri Ergun and Ernest H. Bean entitled "Magnetic Separation of Pyrite from Coals", published by the Bureau of Mines (1968), U.S. Department of the Interior, Report of Investigations 7181. The authors propose certain approaches employing dielectric heating of coals at selected frequencies to enhance the paramagnetism of pyrite by selectively heating the pyrite to transform some of it into pyrrhotite, which has nearly 1,000 times the magnetic susceptibility of pyrite. The authors state (at page 23) "In this type of heating, pyrite need not be crushed to be reactive; indeed, the opposite is true, that is, the coarser the pyrite, the more readily it will be heated. Crushing process necessary to liberate pyrite can be done after dielectric heating". However, this does not address the treatment of those coal types in which the pyrite exists in particle sizes smaller than, for example, 50 micrometers, and in some cases as small as 10 micrometers.

In a more recent paper entitled "Significance of Colloidal Pyrite Distribution for Improving Sulfur Determinations in Coal" by R. T. Greer, Department of Engineering Science and Mechanics and Engineering Research Institute, Iowa State University, Ames, Iowa 50011, published in Proceedings of the International Symposium of Analytical Chemistry in the Exploration, Mining and Processing of Materials, Johannesburg, Republic of South Africa, August 23-27, 1976, at pages 171-174, 1976, it is stated that pyrite is the major source of sulfur in coals, and that in order to free the sulfur-bearing phases from the organic matrix of the coal, it is important to require that the coal be pulverized to particles smaller than will pass through a standard 400 mesh seive. I have found that in many different types of coal, especially coals enclosing pyrite particles in sizes as small as or smaller than 50 micrometers, crushing or pulverizing the coal may not be sufficient to physically separate enough of the pyrite from the coal matrix to enable the sulfur content of the coal to be reduced to an acceptable level. I have found also that industrial processes and apparatus that are currently available for separating components of a mixture of particles have not reached the capability of handling coal that is pulverized to less than 200 mesh. Coal which is pulverized so fine resembles dust; it tends to form clumps after being pulverized and, if successfully de-agglomerated, it tends to form dust-like clouds in high tension separator apparatus which otherwise appears to be highly desirable for performing the end step of separating the pyrite from the coal.

GENERAL DESCRIPTION OF THE INVENTION

The invention consists of a new process for reducing the sulfur content of coal. The process comprises as a first step pulverizing the coal to minus 200 mesh so as to provide a mixture of coal and pyrite particles in which the majority of the pyrite particles are physically freed from the coal matrix, and as a second step applying a silent corona A.C. discharge to the mixture in the presence of a gas to separate the particles each from the other so as to de-agglomerate the mixture whereby to provide a mixture in which the surfaces of substantially all the particles are accessible for contact treatment. The A.C. corona "silent discharge" ionizes the gas between the electrodes, creating a large number of both positive and negative ions in the gas. This "silent discharge" also converts a fraction of the gas molecules into nascent atoms of the gas. Presence of coal and pyrite particles in the ionized gas discharges any electrostatic charge on the particles. If the gas is capable of reacting with coal or pyrite, the ionized gas molecules react with the surfaces of the pyrite or the coal particles, converting the selected substance to another compound. For example, hydrogen in the gas will react with iron disulfide (pyrite) converting the surface layer of this substance into iron and the sulfur into a very small quantity of hydrogen sulfide gas. The iron is both electrically highly conductive, and strongly magnetic. This process step alters substantially all the pyrite particles to a depth of at least one molecule to a new chemical form characterized by enchanement of at least one of the pre-existing differences in magnetic susceptibility and electrical conductivity between the pyrite and the coal components of the mixture. THe process thereafter, in a third step, employs one or both of these enhanced property differences to improve separation of said components one from the other.

The step of pulverizing coal containing pyrite particles in the range 50 micrometers or smaller may fail to separate enough of the pyrite component from the coal component to allow subsequent steps of the process to achieve the required sulfur-content reduction. In such cases pulverizing the coal to even smaller sizes than minus 200 mesh may, instead bring about increased difficulties in handling the smaller-mesh powders that will be produced. I have found that certain chemicals may be used to weaken the bond between the smaller-size pyrite particles and the coal matrix prior to the crushing or pulverizing step, after which the effect of the pulverizing step is increased so that pyrite particles as small as 37 micrometers can be physically separated from the coal matrix. For example, if a sample of coal of this type is wetted in an aqueous solution of ammonia or potassium hydroxide for a few hours at atmospheric pressure and ambient temperature, and then dried, the step of pulverizing this sample to minus 200 mesh will achieve increased physical separation of the pyrite component from the coal component.

In a preferred process, the final step is performed in a high tension separator, using a process heretofore generally called "electrostatic separation". The term "electrostatic separation" as used in this specification is intended to have the scope of meaning that is ascribed to it in "Chemical Engineers' Handbook", Robert H. Perry and Cecil H. Chilton, Editorial Directors; 5th Edition 1973, in the article entitled "Electrostatic Separation" at pages 21-62 to 21-65—McGraw-Hill Book Company, New York, N.Y.

DETAILED DESCRIPTION OF THE INVENTION

The invention is further described with reference to the accompanying drawings, in which:

FIG. 1 illustrates in a general way the process of the invention. As illustrated, the process comprises three steps, each of which is susceptible of being performed in a variety of ways.

Figure 1:
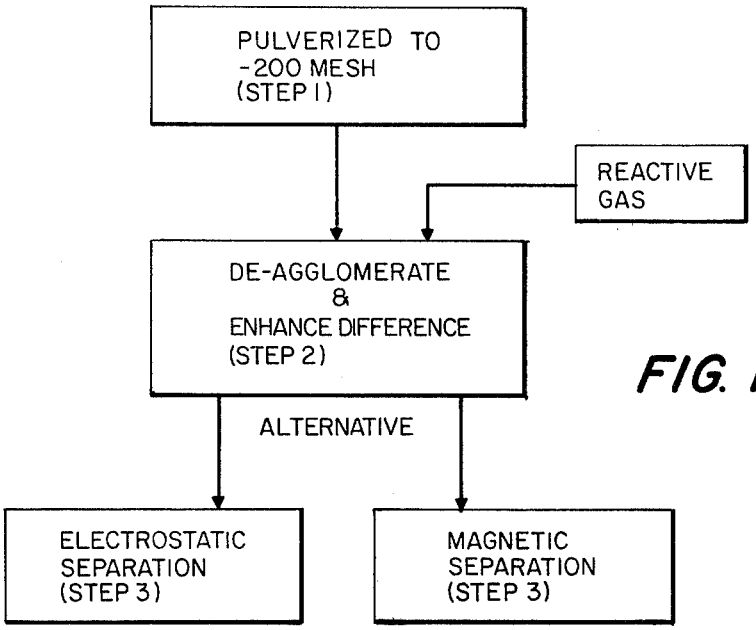
FIG. 1 is a block diagram generally illustrating the invention.

In Step 1 the coal is pulverized to −200 mesh. It is now known that pyrite is the major source of sulfur in coals, and that pyrite can be distributed in coals on a scale finer than 50 micrometers (μm). In order to separate the particles of pyrite physically from the coal matrix in which they are bound, the coal must be pulverized to −200 mesh or finer. However, coal that is pulverized so fine is difficult to handle. In a gaseous medium, such as air, the motions of the very small particles of both coal and pyrite, many of which have essentially the same effective aerodynamic diameters, are governed essentially by Stokes' Law defining resistance to motion, $$R=6\pi\eta av$$

where, "η" is the fluid viscosity, "a" is the radius of the particle (sphere), and "v" is the velocity of the particle. Mass is not relevant at the small particle sizes that are present, with the result that the particles of both coal and pyrite are easily carried or scattered together throughout an ambient gaseous environment and, conversely, one is not separable from the other by the force of gravity alone.

Once the coal and pyrite are pulverized to the size range required to free a substantial percentage (i.e.: the majority) all of the pyrite physically from the coal, these two components can be differentiated in many ways, so as to enable one component to be separated from the other in subsequent process steps. More particularly, the next step in the process, Step 2, involves the conversion of pyrite into a form capable of either magnetic or electrostatic separation from the coal. As it concerns the former, magnetic separation, pyrite, an essentially non-magnetic substance, can be converted into a magnetic material by thermal means (some of which are known), or by chemical means. As it concerns the latter, pyrite is relatively more conductive, electrically, than is coal, and this difference can be enhanced by chemical means, or by electrical means, or both acting together, so as to render the pyrite functionally far more conductive, electrically, than is the coal, and thereby more easily capable of separation from the coal by electrostatic means.

Magnetic separation of Pyrite from Coals is the subject of a paper bearing that title by Sabri Ergun and Ernest H. Bean, published by the Bureau of Mines (1968), U.S. Department of the Interior, Report of Investigations 7181. The authors point out that some of the pyrite is converted into ferromagnetic compounds of iron when heated to temperature greater than 500° C. Dielectric heating of coals in the Ghz frequency range is suggested as the most feasible method of enhancing the paramagnetism of pyrite. Selective heating of the pyrite was recognized in this report. However, the heating times were such (up to 30 minutes in one example) that the coal was also heated to a substantial degree, requiring prohibitive total energy input. This is borne out in N.T.I.S. Report No. PB 285-880.

According to the present invention, the paramagnetism of pyrite particles is more economically enhanced by chemically or electrically transforming the surfaces of the pyrite particles into compounds that are more magnetic than iron disulfide (pyrite). This is done chemically, for example, in a treatment of pyrite and coal with halogen gases or the vapors of their acids, such as hydrochloric, hydrobromic or hydroiodic, so as to transform the pyrite particle surface into ferrous or ferric chloride, bromide, or iodide. These compounds, in addition to being more magnetic than iron disulfide, are less expensive to produce than pyrrhotite, the compound which is produced by heating of the pyrite.

The surface chemistry of pyrite particles can be electrically altered with an A.C. silent corona discharge. Recombinations of ions on the surfaces of the particles will result in high local temperatures (as in corona nitriding of steel) which, if carried out in the presence of an appropriate gas or gasses, will in turn effect a desired chemical reaction. A reactive gas may be introduced along with the pulverized coal and pyrite, between Step 1 and Step 2, as is indicated in FIG. 1.

In each of these examples, it is the surface of each pyrite particle that is transformed into a compound or compounds that are more magnetic than iron disulfide. It is necessary only to convert a shallow surface layer of each pyrite particle to a more magnetic chemical, and this is an energy-saving feature of the invention. It is presented also in the following examples of steps for converting the pyrite into a form that is more capable of electrostatic seperation from coal.

Electrostatic separation of one type of particle from another is possible even when the resistivities are as close as within two or three orders of magnitude. This is sometimes the difference between the electrical resistivities of pyrite versus coal, the pyrite being inherently more electrically conductive than the coal. Electrodynamic separators (employing charging by ion bombardment) are commercially available which can separate particles having a ratio of electrical conductivities approximately five or six orders of magnitude. It is necessary only to convert a shallow surface layer of each pyrite particle to a highly conductive chemical in order to render the pyrite particles functionally far more conductive than are the coal particles; that is, to enhance the pre-existing difference in the electrical conductivities of the two materials.

In theory, the enhanced-conductivity surface layer on each pyrite particle need be only a molecule or so in depth. This means that a reaction can take place nearly instantaneously, and it is within the scope of this invention to effect such a reaction at any convenient time after the coal/pyrite mixture leaves the pulverizer.

Figure 3:
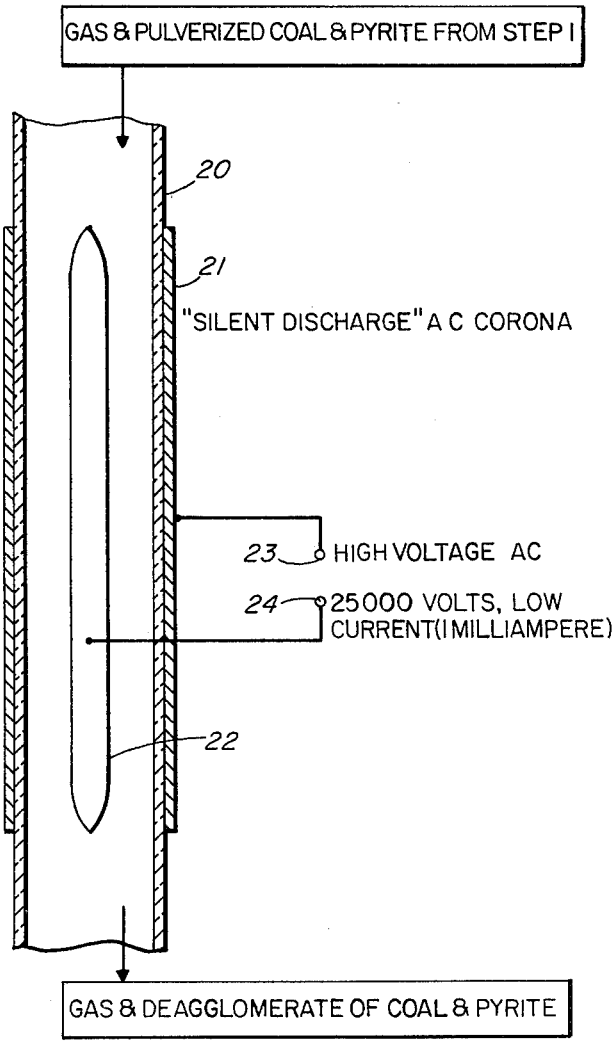
FIG. 3 illustrates a silent discharge device for deagglomerating the pulverized mixture of pyrite and coal.

According to the invention, the electrical conductivity of pyrite particles can be enhanced through electrical means combined with chemical means, by passing the pyrite in the form of finely-divided particles, preferably carried in a reactant gas or vapor, between electrodes at least one of which is insulated by a suitable dielectric, and applying between the electrodes an A.C. voltage sufficiently high to cause a silent corona discharge, and thereby create both positive and negative ions in the carrier gas (See FIG. 3). Recombinations of ions on the surface of the pyrite particles result in high local temperatures which if effected in the presence of a reactant carrier gas or vapor will in turn promote or accelerate desired reaction or reactions with such gas or vapor. The recombinations of ions will take place on the surfaces of both the pyrite particles and the coal particles, and intense local heating of these surfaces will result in accelerated chemical reactions between the carrier gas and one or both materials—the pyrite and/or the coal. The carrier gas or vapor ought therefore to be chosen so as to favor the desired reaction with the pyrite and to avoid or minimize a reaction with the coal.

The surfaces of the pyrite particles can be converted into an electrically more conductive compound by reacting the coal/pyrite mixture with chlorine gas, for example just after the mixture leaves the pulverizer, so as to transform the surface layer into ferrous and/or ferric chloride.

I have found in working with coal pulverized to minus 200 mesh that the coal particles tend to agglomerate, and form clumps. This tends to frustrate any following process step which requires access to the surface of the particles (e.g.: surface conductivity enhancement in the pyrite particles by chemical means, or particle separation in apparatus which depends upon charging the particles by ion bombardment). I have found, further, that the particles of a −200 mesh mixture of coal and pyrite are de-agglomerated by passng the mixture through an A.C. silent discharge following the pulverizing step (Step 1). This step of de-agglomerating the particles of the mixture provides access to the surfaces of substantially all the particles, and greatly increases the opportunity to enhance the pre-existing electrical and/or magnetic difference between pyrite and coal, and hence the opportunity to succeed in separating the sulfur-bearing pyrite particles from coal particles. Thus, Step 2 of the process of this invention simultaneously de-agglomerates the mixture of pyrite and coal particles and more greatly enhances a pre-existing difference in their relative electrical conductivity properties and/or their relative magnetic susceptibility properties. Step 3 of the process, which can be performed in any of a variety of known ways, is thereby rendered more effective, and improved.

Figure 2:
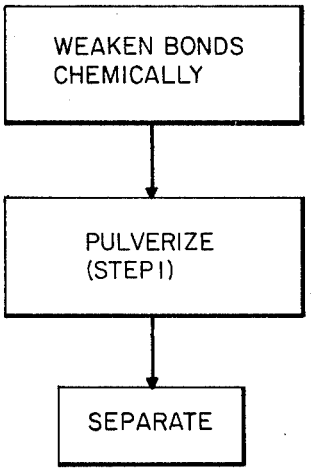
FIG. 2 illustrates the preliminary step of chemically weakening bonds between pyrite and coal components.

Referring to FIG. 2, the bond between pyrite particles and coal matrix is weakened chemically in a preliminary step, block 10, taken prior to Step 1 of the process as described with reference to FIG. 1. This preliminary step has been found effective to enhance the subsequent physical separation of the pyrite component from the coal component of a bituminous coal sample in which the pyrite exists in sizes down to about 50 micrometers. As an example, a quantity of coal containing 3.11% pyritic sulfur was treated with a chemical comminutant, in this example an aqueous solution of 29% ammonia at atmospheric pressure and ambient temperature for a few hours, and then dried, after which it was pulverized in a hammer mill to minus 200 mesh. The pulverized sample was then treated with Step 2 and electrostatically separated in Step 3. The coal recovered after Step 3 had a sulfur content of 0.95%. The pyrite sulfur content was reduced 75%.

In FIG. 3, a dielectric tube 20 (made, for example, of "Pyrex" glass) has an electrically conductive first electrode 21 on its outer surface, and an electrically conductive second electrode 22 axially located within it. The second electrode can be supported by any suitable holding means (not shown) presenting the smallest possible impediment to flow of the gas and particle mixture. Alternatively, the tube 20 can have two outer electrodes on opposing outer surfaces, in which case the tube walls covered with the electrodes should preferably be flat so that the electrodes will be evenly spaced along the path through which the gas (or vapor) and particle mixture flows. A pair of terminals 23, 24 are connected one to each electrode 21, 22, respectively, and an A.C. high voltage approximately 25,000 volts at a low current approximately 1 milliampere is applied across these terminals to produce a silent corona discharge between the electrodes. The gas (or vapor) and particle mixture is passed through this A.C. silent corona discharge, thereby to ionize the gas (or vapor) so as to promote a reaction between the gas (or vapor) and at least the pyrite component in the coal and pyrite mixture, with the results that are described above.

The effect of the A.C. silent corona discharge, whether or not a reactant gas or vapor is present, is to deagglomerate the particles in the coal and pyrite mixture. When a mixture pulverized to 200 mesh is passed through the tube 20 and suitable A.C. voltage is applied at terminals 23, 24, the particles execute rapid motion back and forth between the electrodes 21, 22, and transverse to the direction of their passage between the electrodes, so much so that the interior of the tube becomes clouded with moving particles and blocks substantially the light that would otherwise pass through the tube. The output from the tube is a deagglomerated mixture of coal and pyrite. When a reactant gas is also present, the pyrite has been altered to enhance its electrical and/or magnetic properties, as is described above. This output is supplied to separating means in Step 3.

I claim:

1. A process for reducing the sulfur content of coal comprising the steps of pulverizing the coal to at least minus 200 mesh particles so as to free a substantial percentage of the pyrite component physically from the coal component, passing a mixture of said particles of the coal and the pyrite through an A.C. silent corona discharge so as to reduce adhesion by electrostatic forces and thereby de-agglomerate substantially all the particles, and thereafter separating said components one from the other.

2. A process according to claim 1 including, simultaneously with said de-agglomerating, altering the chemistry of the pyrite to enhance the difference in electrical conductivity between the pyrite component and the coal component, and thereafter electrostatically separating said components one from the other.

3. A process according to claim 1 including, simultaneously with said de-agglomerating, increasing selectively the magnetic susceptibility of the pyrite component relative to the coal component, and thereafter magnetically separating said components one from the other.

4. A process for reducing the sulfur content of coal comprising the steps of pulverizing the coal so as to free a substantial percentage of the pyrite component physically from the coal component in a mixture of said components, passing said pulverized mixture through an A.C. silent corona discharge to de-agglomerate substantially all of the particles of the mixture and simultaneously to alter the surfaces of substantially all the pyrite particles to a depth of at least one molecule to a new chemical form having at least one of its magnetic susceptibility and its electrical conductivity substantially enhanced relative to the coal component, and thereafter separating said components one from the other.

5. A process according to claim 4 wherein the electrical conductivity of the pyrite particles is enhanced, including the step of electrostatically separating said components.

6. A process according to claim 4 wherein the magnetic susceptibility of the pyrite particles is enhanced, including the step of magnetically separating said components.

7. A process according to claim 1 including the preliminary step of treating the coal with a suitable chemical so as to weaken bonds between the coal matrix and pyrite particles, and thereafter pulverizing the coal to physically separate the pyrite component from the coal component.

8. A process according to claim 7 wherein the chemical is 29% ammonia in water, and the coal is wetted in that solution, and thereafter the coal is pulverized.

* * * * *